US007581724B2

(12) United States Patent
Stauber

(10) Patent No.: US 7,581,724 B2
(45) Date of Patent: Sep. 1, 2009

(54) DEVICE FOR COLLECTING AND PROCESSING FOLDED PRINTED PRODUCTS

(75) Inventor: Hans-Ulrich Stauber, Grüt (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/700,769

(22) Filed: Nov. 5, 2003

(65) Prior Publication Data

US 2004/0089991 A1 May 13, 2004

(30) Foreign Application Priority Data

Nov. 9, 2002 (CH) ..... 1886/02

(51) Int. Cl.
*B65H 37/04* (2006.01)

(52) U.S. Cl. ..... 270/52.3; 270/52.26; 270/52.29

(58) Field of Classification Search ..... 270/52.26, 270/52.29, 52.3
See application file for complete search history.

(56) References Cited

U.S. PATENT DOCUMENTS

| | | | | |
|---|---|---|---|---|
| 3,951,399 A | | 4/1976 | Reist | |
| 4,605,213 A | | 8/1986 | Hechler | |
| 4,641,825 A | * | 2/1987 | Mowry et al. | 270/52.26 |
| 4,811,938 A | * | 3/1989 | Hansch | 270/52.27 |
| 4,981,291 A | * | 1/1991 | Honegger et al. | 270/52.3 |
| 5,098,002 A | | 3/1992 | Hänsch et al. | |
| 5,172,897 A | * | 12/1992 | Hansch et al. | 270/52.18 |
| 5,562,278 A | * | 10/1996 | Muller et al. | 270/58.21 |
| 5,590,828 A | | 1/1997 | Stauber | |
| 5,634,758 A | | 6/1997 | Leu | |
| 5,657,978 A | * | 8/1997 | Meier et al. | 270/52.16 |
| 6,003,859 A | * | 12/1999 | Reist | 271/204 |

FOREIGN PATENT DOCUMENTS

| | | |
|---|---|---|
| CA | 2125094 | 8/2005 |
| CH | 645074 | 9/1984 |
| CH | 667621 | 10/1988 |
| CH | 686078 | 12/1995 |

(Continued)

*Primary Examiner*—Gene Crawford
*Assistant Examiner*—Leslie A Nicholson, III
(74) *Attorney, Agent, or Firm*—Pauley Petersen & Erickson

(57) ABSTRACT

A device (10) for collecting and processing folded printed products (12) may be constructed with a collection drum (14) which is rotatingly driven about its drum axis (22) and provides first rests (18) with first saddles (20). The first rests are uniformly distributed over the circumference and extend in their longitudinal extension (L1) parallel to the drum axis (22). Conveyor elements convey the printed products (12) on the first saddles (20) in the axial direction (S) along the firsts rests (18). It may further use a conveyor (30) which has a conveyor path (31) with a conveyor direction (F) which at least in a transfer region (50) deviates from the axial direction (S) and which has second rests (32) movable in the conveyor path (31), with second saddles (34) arranged distanced to one another and arranged transversely to the conveying direction (F). The conveyor (30) in the transfer region (50) is arranged adjacent to a collection drum end (24) of the collection drum (14) in a manner such that the printed products (12) may be transferred from the collection drum end (24) to the conveyor (30) or vice versa. For the second rests (32) movable in the conveyor path (31) there is provided a conveyor unit (35) detached from the collection drum (14).

23 Claims, 8 Drawing Sheets

FOREIGN PATENT DOCUMENTS

| | | |
|---|---|---|
| EP | 0399317 | 11/1990 |
| EP | 0546326 | 6/1993 |
| EP | 0566531 | 10/1993 |
| EP | 0606555 | 7/1994 |
| EP | 0618865 | 10/1994 |
| EP | 0675005 | 10/1995 |
| EP | 0681979 | 11/1995 |

* cited by examiner

DEVICE FOR COLLECTING AND PROCESSING FOLDED PRINTED PRODUCTS

CLAIM OF PRIORITY

This application makes reference to, incorporates the same herein, and claims all benefits accruing under 35 U.S.C. §119 from my application entitled A DEVICE FOR COLLECTING AND PROCESSING FOLDED PRINTED PRODUCTS filed with the Swiss Federal Institute of Intellectual Property on 9 Nov. 2002 and there duly assigned Ser. No. 2002 1886/02.

BACKGROUND OF THE INVENTION

1. Technical Field

The invention relates to a device for collecting and processing folded printed products.

In order to manufacture newspapers, stapled magazines, advertising brochures, calendars or similar printer's products, the printed sheets after printing may further run through various working steps. Such working steps amongst other things may be collection, insertion, binding, and in particular saddle stitching, adhering etc. The increasing costs of printing and the increased demands on the flexibility during production demand newer solutions which permit savings in space, time and personnel. Various solutions which are to permit such savings have been suggested in recent years, 2. Prior Art Thus for example in CH-667621 there has been suggested a device which permits an efficient collection and stapling in a single device. The device comprises a generally known collection drum which has a rotatingly driven drum axle with a cylindrical hub from which rests project radially outwards, whose longitudinal extensions are aligned parallel to the drum axis. The rests are uniformly distributed over the circumference and form several parallel collection paths. To each collection path there are allocated conveyor elements for conveying the printed products along the rests in the axial direction of the collection drum. Several feeder stations which, when seen in the axial direction are arranged behind one another along the collection drum, serve for depositing the folded printed products astride one another onto the saddle-like rests. So that the feeder stations may serve all collection paths, the collection drum rotates at an equal cycle rate to the feeder stations about its drum axis. Thus the printed products within the conveying direction undergo a movement in the circumferential direction about the drum axis so that as a whole there results a helix-like movement path of the printed products. For an efficient stapling after the collection, a stapling station is provided at the end of the collection drum, whose stapling heads are moveable on a circular arc section concentric to the axis of the collection drum. For stapling, the stapling heads are in each case allocated to a rest of a collection path and together with the rest is led around on the circular arc section about the axis of the collection drum. With the help of the stapling heads, wire sections bent in a U-shaped manner are pierced through the fold of the printed products so that free ends of the wire sections protrude. These free ends of the wire sections are bent into staples using bending devices, by which means the printed products are stapled.

Based on the same principle, CH-645074 discloses a device for collecting and stapling printed products present in zigzag-like sheets. The zigzag sheets in each case one after the other are deposited with a corresponding fold astride the rests of a collection drum and conveyed in helix-like movement path in the axial direction to a collection drum end. The stapling of the zigzag sheets is again effected in the end region of the collection drum.

If there are to be effected further working steps at the collection drum, then the collection drum must be extended in the axial direction which leads to very great construction lengths and this exceeds the spatial possibilities at many locations. Furthermore, one may only carry out working steps at collection drums which may be carried out with an access to the folded printed products from the outside.

The device for collecting and stapling folded printed products which is disclosed in EP-B1-0566531 is based on a completely different principle. Here the saddle-like rests are not directed in their longitudinal extension to the conveying direction as in the previously described devices, but the longitudinal extension of the rests is directed essentially at right angles to the conveying direction. The rests seen in the conveying direction are arranged behind one another and essentially parallel to one another. They are part of a revolving conveying means and are moved in a closed conveying path. For this there are provided conveyor devices engaging on the rests, such as e.g. chains which are led around two diverting wheels. The printed products in this device, resting of the rests, are moved together with the rests in the conveying direction instead of being moved on the rests using conveyor elements. On a section of revolving conveyor means which is described as a charging region, feeder stations are allocated to the feed path which deposit the folded printed products on the rests astride one another. The rests with the collected printed products are then led to the one diverting wheel to which there is allocated a stapling apparatus. The diverting wheel comprises benders distributed uniformly over its circumference which radially outwards have the same distance to one another as the feed rests and are drivingly connected to these. The rests mesh with the benders and together with the collected printed products and the benders are led past the allocated stapling apparatus. Then in the known manner wire sections bent in a U-shaped manner by the stapling apparatus are pierced through the printed products and are bent into staples using the driven bender. The meshing of the rests with the benders demands complicated mechanics and renders the device expensive and awkward in maintenance. In CH-686078 or the corresponding EP-B1-618865 there is presented a stapling apparatus in detail which is allocated to the revolving conveyor means which corresponds essentially to the revolving conveyor means described in the above mentioned EP-B1-0566531. Tn place of a deflection wheel with benders, in these documents there are described two parallel diverting wheels and additionally two stapling wheels provided with benders, which additionally complicates the construction.

EP-B1-0399317 also shows a revolving conveyor means for collecting and stapling printed products. As in the above-described revolving conveyor means here too the printed products together with the rests are conveyed along a closed conveyor path transversely to the conveying direction. The rests are arranged perpendicular to the conveying direction and parallel behind one another seen in the conveying direction. For collection the printed products again using feed stations are deposited astride the saddle-like rests. In contrast to the devices described in the previous paragraph, with this device however the benders are integrated into the rests. A stapling station is arranged after the feed station seen in the conveying direction, and comprises several stapling heads. The distance of the stapling heads is matched to the distance of the rests which these have to one another in the region of the stapling station. The stapling heads during stapling move synchronously to the rests in a plane running transversely to the rests and for stapling cooperate with benders in the rests.

As with the collection drums, with the revolving conveyor means there too arises the problem that for additional processing steps the constructional length needs to be extended in the conveying direction, which is not infinitely possible. A further problem with the revolving conveyor means is that forces which occur during certain working steps, such as e.g. stapling may only be accommodated at certain locations, in EP-B1-0566531.

One possibility for the flexible use of space for various working steps is disclosed in EP-B1-0681979. With this device for collecting and processing folded printed products a collection drum is combined with a revolving conveyor. The collection drum in the usual manner serves the collection of the printed products. The collected printed products are transferred to the revolving conveyor and here may be subjected to further working steps, i.e. adhesive binding or stapling, wherein adhesive binding is shown in detail in EP-A1-0675005. The axial direction of the collection drum and the conveyor direction in the revolving conveyor are perpendicular to one another in this device. On collection of the printed products these are moved along on the rests to a first collection drum end. The collection drum end is determined by the end of the rests of the collection drum. The hub of the collection drum on the other hand extends beyond the end of the collection drum. The revolving conveyor is arranged adjacent to the collection drum end. Chains which serve as conveyor devices in the revolving conveyor and engage radially on the inside on its rests are led around that part of the hub projecting beyond the collection drum end. This part of the hub thus serves as diverter means in the revolving conveyor and thus becomes an integral part of this. A common drive thus simultaneously provides for the rotation movement of the collection drum and for the conveyor movement of the rests in the revolving conveyor. The distance between the rests moved in the revolving path is dimensioned such that these, when they are conveyed in the region of the collection drum, are flush with the rests of the collection drum, by which means a simple transfer of the printed products from the collection drum to the revolving conveyor is possible. The printed products processed in the revolving conveyor, based on the same design, may be transferred to a further collection drum arranged displaced to the first collection drum but may also be led back to the first collection drum on a lower side belt face of the revolving conveyor and transferred to a further collection section of the first collection drum.

Although this design permits a higher flexibility of the use of space, however with this device too the use of the space is restricted since the folded printed products in each case may only be transferred in the diverting region of the revolving conveyor from the collection drum to the conveyor and from the conveyor means to the collection drum.

SUMMARY OF THE INVENTION

The object of the invention lies in providing a device for collecting and processing printed products with which an even more flexible use of space is possible.

A device with the features defined by the patent claims achieves this object.

The device according to the invention may be constructed with a collection drum which is rotatingly drivable about its drum axis. The collection drum may provide first rests with first saddles on which folded printed products may be conveyed in the axial direction to one collection drum end using conveyor elements. The device may further use a conveyor with a conveyor path whose conveying direction deviates from the axial direction of the collection drum. The conveyor in the conveyor path may have movable second rests with second saddles arranged transversely to the conveying direction. The conveyor in a transfer region in which the printed products may be transferred from the collection drum to the conveyar or also from the conveyor to the collection drum is arranged adjacent to the collection drum end. According to the practice of the invention, the device for conveying the second rests in the conveyor path of the conveyor may have a conveyor unit releasably detachable from the collection drum. Since no part of the collection drum is an integral component of the conveyor, it becomes possible to place the conveyor path in the room more or less independently of the collection drum and to transfer printed products to the conveyor in any region of the conveyor path. The connection to a diverter is then superfluous and the use of the available space thus becomes more flexible.

If the two saddles at least in the transfer region, are movable parallel to one another at a predefined, equal distance in the conveyor path, then the printed products may be transferred more simply. The transfer is particularly simple if in the transfer region the predefined equal distance between the two saddles in the conveyor path corresponds to the distance between the first saddles in the circumferential direction of the collection drum.

The transfer may be realized most simply if the collection drum and the conveyor unit are driven by a common motor. The drive with two separate motors is also conceivable. It is particularly advantageous to match the conveyor speed of the conveyor unit and the rotation speed of the collection drum to one another in a manner such that in each case one first saddle and one second saddle with their side facing one another always reach the transfer region essentially at the same time and runs through it at essentially the same speed.

The transfer is further simplified if a deflector is provided in the conveyor direction in the transfer region and when this is used, the second rests may be conveyed in the conveyor path in a manner such that at least the sides which face one another, of the first saddle and of the second saddle, run through circular arc sections on adjacent planes. It is particularly favorable if the circular arc sections are arranged concentric to one another. It is likewise advantageous if the circular arc sections are arranged on planes parallel to one another. The transfer is even simpler if the circular arc sections have the same radius. It is also conceivable to select the radius of the two circular arc sections different from one another and/or to provide the circular arc sections displaced to one another in a manner such that the printed products experience a movement direction encouraged by gravity on transfer from the collection drum to the conveyor or from the conveyor to the collection drum.

The second rests in the conveyor path of the conveyor may be arranged in an angular region of essentially 30° to 90° transversely to the conveyor direction so that by way of this one may also influence the required spatial length or spatial width. Such an arrangement may also be advantageous if the conveyor direction of the conveyor and the axial direction of the conveyor drum in the transfer region are not perpendicular to one another.

If the axial direction and the conveyor direction in the conveyor are arranged perpendicular to one another at least in the region of the transfer region, then the transfer of the printed products may be realized very simply and inexpensively.

In a preferred embodiment form, in the end region of the collection drum there are provided conveyor elements which convey the printed products beyond the collection drum end to the conveyor. Such conveyor elements may be allocated to the second rests for the reverse transfer of printed products from the conveyor to a collection dram.

The usability of the conveyor for various additional working steps is particularly improved if the second rests are supported on rails in the conveyor path of the conveyor.

In a particularly preferred embodiment form the second rests on their sides opposite to the saddles are movably supported on at least one rail. In a further preferred embodiment form the second rests additionally in their half lying close to the saddle on their sides distant to the collection drum are movably supported on or in a rail, which increases the stability. The support on or in the rails may be realized most simply using rollers or carriages running in or on the rails. In such a case the conveyor advantageously engages the rollers or carriages of the rests. With rail-supported second rests one may particularly simply arrange further working stations such as inserting stations, adhesing stations, further collection stations and many others along the conveyor path. In this manner the conveyor may be used particularly efficiently.

A further collection in the region of the conveyor path, thus a further depositing of printed products on the second rests using feeder stations and feeder devices may be useful if e.g. further printed products are to be deposited onto printed products which have already been bound and then, for example a further binding is to be effected. Also all other working stations in the region of the conveyor path may be combined in a useful sequence and repeatedly arranged.

If for processing the printed products one uses working stations with several working heads whose distance is adapted to the distance of the rests, then it is particularly advantageous if the second saddles of the second rests in the whole conveyor path are movable parallel at a predefined equal distance to one another. In this manner these working stations indeed may be allocated to various locations of the conveyor path specifically without any adaptation. If bending mechanisms are integrated into the second rests, then a binding apparatus may be allocated to the conveyor path at various locations.

Predefined, equal distances of the second saddles to one another on the whole conveyor path may be particularly simply realized if conveyor devices are provided in the conveyor, which cooperate with the second rests in their half which is closest to the saddles.

An advantageous effect is likewise produced if the second rests are constructed with two limbs which are connected to one another in an articulated manner in the saddle region, and each limb at its end lying opposite the second saddle is connected in an articulated manner to the limb of the adjacent second rest.

The conveyor may then be designed as a revolving conveyor with an upper and a lower side belt face. It may however, also be designed in the form of a conveyor with an essentially horizontal conveyor path, wherein the conveyor path is designed such that rests conveyed in it may also overcome certain level differences.

If the conveyor is designed as a revolving conveying with an upper and lower side belt face, it is very advantageous if in the region of the lower side belt face and in the region of the diverter which conveys from the upper to the lower side belt face there is provided a safety system which secures the printed products from falling down from the second rests. In this manner the upper and lower side belt face of the revolving conveyor may be used for processing the printed products. In the region of the lower side belt face one may for example provide inserting stations and/or stations for adhesing in cards or sample packages. Particularly favorable locations for these stations are the regions of the conveyor path in which the second rests are aligned essentially horizontally downwards or aligned inclined downwards up to 35° from the horizontal.

If in contrast, a product is to be adhesed onto the outer printed products, then it is simplest to arrange an adhesing station in a region of the conveyor path in which the second rests are aligned upwards or obliquely upwards. Further preferred method steps or embodiment forms of the device according to the invention are specified in the further dependent claims.

BRIEF DESCRIPTION OF THE DRAWINGS

In the following the subject-matter of the invention is explained in more detail by way of preferred embodiment examples which are shown in the accompanying drawings. There are shown purely schematically in.

Basically in the figures, the same parts are provided with the same reference numerals. The described embodiment forms are but examples of the subject-matter of the invention and have no limiting effect.

DETAILED DESCRIPTION OF THE PREFERRED EMBODIMENTS

Figure 1:
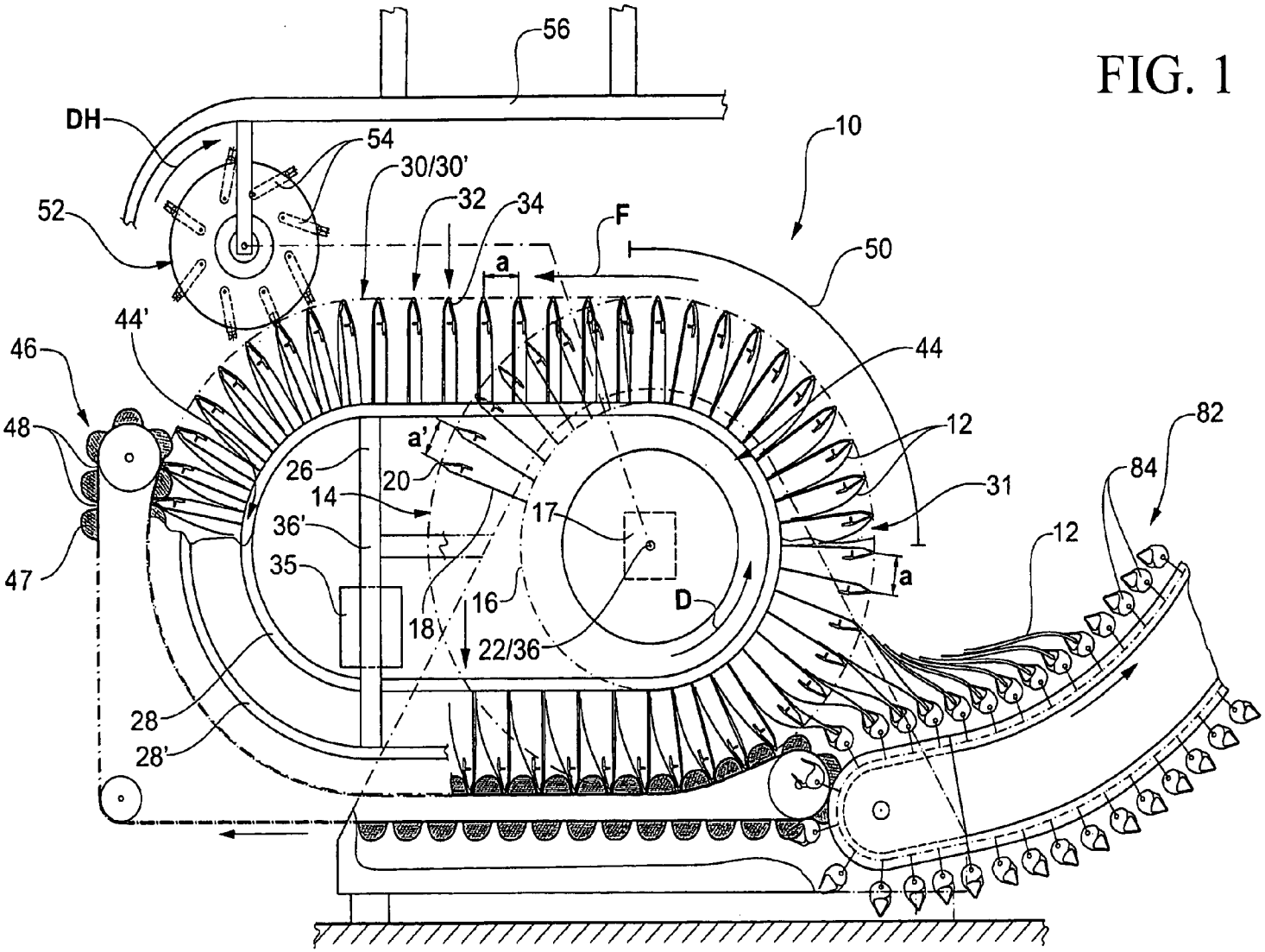
FIG. 1 which schematically illustrates in an elevation view, a device according to the invention with a conveyor designed as a revolving conveyor.
Figure 2:
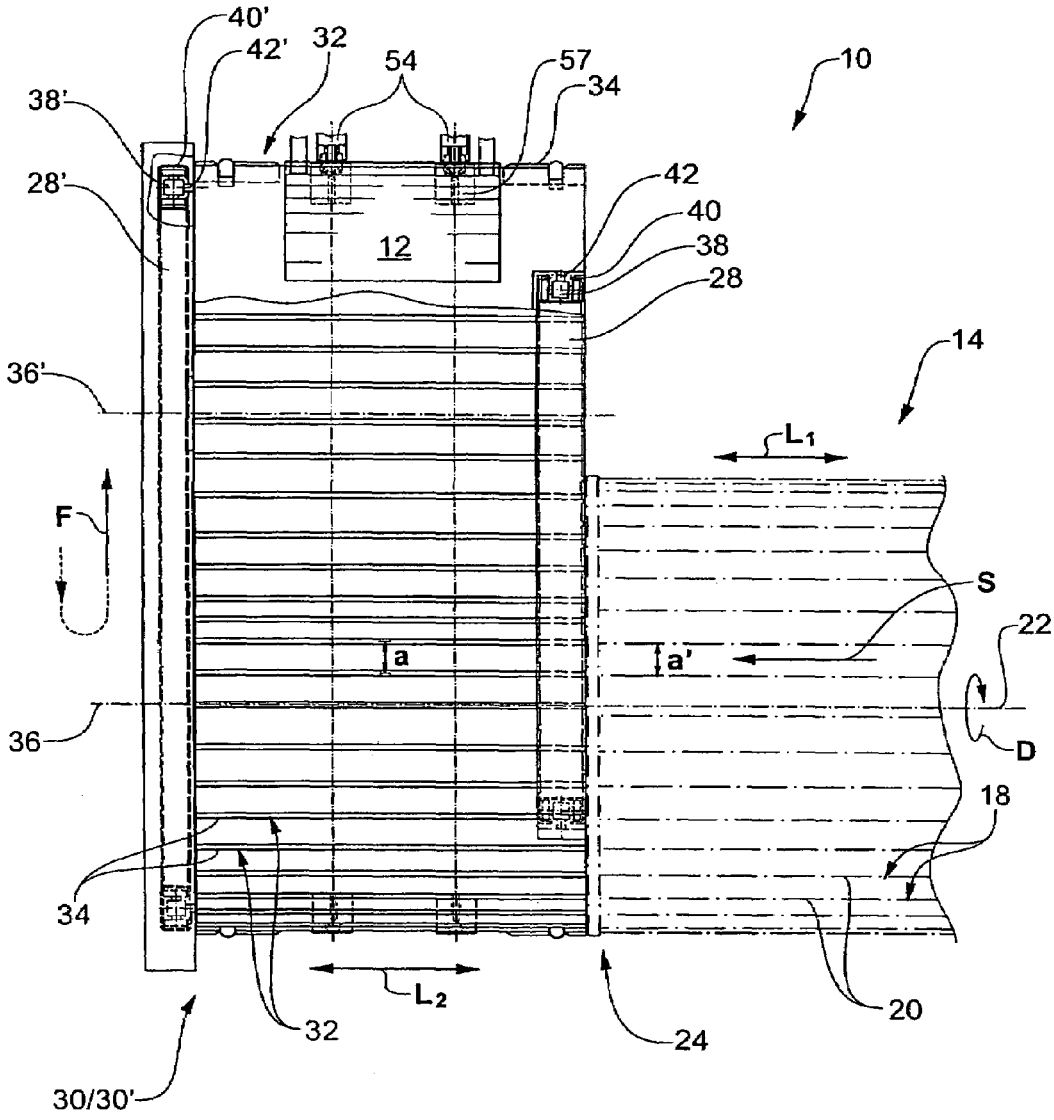
FIG. 2 which schematically illustrates the device according to the invention of FIG. 1, in a plan view.

The FIGS. 1 and 2 show a device constructed according to the principles of the invention 10 for collecting and processing folded printed products 12. In FIG. 1 the device 10 is shown in a lateral view with printed products 12, in FIG. 2 in a plan view without printed products 12. A collection drum 14 known per se which is indicated with dashed lines, on its hub 16 comprises first rests 18 uniformly distributed over its circumference and projecting radially outwards, with first saddles 20. The rests 18 in their longitudinal extension whose direction is indicted in FIG. 2 by the double arrow indicated at L1, are aligned parallel to the drum axis 22 of the collection drum 14. Using conveyor elements (not shown), printed products 12 deposited on the rests 18 are transportable in the axial direction S of the collection drum 14 from a collection drum beginning (not shown) of the collection drum 14 to a collection drum end 24 of the collection drum 14 which lies in the axial direction S. The collection drum 14 using a motor 17 rotating about its drum axis 22 may be driven in the rotational direction D so that printed products 12 deposited on the first rests 18 and transported in the axial direction S using the conveyor elements describe a helix-like movement path. Not shown are the feeder stations or feeders required for the collecting, which are arranged behind one another seen along the collection drum 14 in the axial direction S and in the known manner deposit the printed products 12 over one another on the rests 18.

Adjacent to the drum end 24 there is positioned a frame 26 which carries a conveyor in the form of a revolving conveyor 30'. The revolving conveyor 30' comprises single part or multi-part rails which in each case form a closed ring and are fastened on the frame 26. In the example shown here there are provided two rails 28, 28' lying diagonally opposite one another, wherein the radial outer rail 28' is arranged on that side of the conveyor 30 distant to the collection drum 14. However also three or also only one rail may be provided. Also when required in sections, one may provide an additional rail piece for support, which then may cooperate with support elements on the second rests 32 which have been specially provided for this. The rails 28, 28' define an annular conveyor path 31 which is illustrated in FIG. 1 radially on the outside by a dot-dashed line. Second rests 32 are arranged on this conveyor path 31 behind one another seen in the conveying direction F and parallel to one another. With the help of a conveyor unit 35 which is connected to the motor 17 and which is fastened on the frame 26, the second rests 32 may be conveyed in the conveyor path 31 of the conveyor 30. The second rests 32, in their longitudinal extension whose direction is indicated by the double arrow indicated at L2 in FIG. 2, are aligned transversely to the conveyor direction and comprise second saddles 34 radially on the outside. In the example shown here the angle between the longitudinal extension L2 and the conveyor direction F is essentially 90°. As is however shown in FIG. 4, it is also possible for the second rests 32 to be movable in the conveyor path 31 at an angle $\alpha$ in a region of essentially 90°±30° transversely to the conveyor direction F. The second rests 32 in the example shown here are guided in the rails 28, 28' such that their saddles 34 on the whole conveyor path 31 radially on the outside maintain a predefined equal distance a which is equal to the distance a' of the first rests 18 in the circumferential direction of the collection drum 14.

The revolving conveyor 30' shown by way of example is equipped with two axes 36, 36' which are arranged essentially parallel to one another and in the embodiment form shown here in a horizontal plane. The first axis 36 here is arranged flush with the drum axis 22 of the collection drum 14 so that the axial direction S and the conveying direction F are essentially perpendicular to one another, wherein the conveying direction F has the same rotational direction D as the collection drum 14. With the same rotational direction D at a slightly obtuse angle up to about 100° between the conveying directions S and F is also for example conceivable.

The second rests 32 in the example shown here on their inner radial side distant to the second saddles 34, using small carriages 38, are guided in two rails 28 arranged parallel to one another of which in each case only one may be seen in some of the drawings. Rail 28 has essentially of a hollow profile 40 with a rectangular cross section which radially on the outside is provided with a guiding groove through which the carriages 38 are connected to the rests 32 via a mount 42. The distance of the two rails 28 to one another corresponds essentially to the longitudinal extension of the second rests 32. In the half of the rest close to the saddle on that side of the rests 32 opposing the collection drum there is arranged a further rail 28' with whose help the second rests 32 are laterally guided in the conveyor path 31. The rail 28' is likewise formed as a hollow profile 40' with a rectangular cross section wherein for the lateral guiding of the second rests 32 there is arranged a guide groove on the side proximal to the second rests 32. Here too the guiding is effected using small carriages 38' whose mounts 42' are connected to the second rests 32 through the lateral guide groove. Of course also all other known rail profiles with corresponding carriages or rollers suitable for this purpose may be applied.

For the movement of the rests in the conveyor direction F, in the example showing here a conveyor unit is fastened on the frame 26 which is actively connected to a conveyor (not shown) which is guided in the rail 28' next to the saddle and which is in engagement with the carriage 38' of the second rests 32. The conveyor unit by way of a gear for example, is connected to the motor 17 which drives the collection drum which simplifies the matching of the conveyor speed in the conveyor path 31 to the rotational speed of the collection drum 14. A separate motor for the conveyor unit 35 of the conveyor is also conceivable. In the example shown here in which a chain is provided in the conveyor 30, the conveyor unit 35 comprises a chain wheel conveying the chain. The arrangement of the radial outer rail 28' in combination with the drive chain guided therein permits the distance a between the two saddles 34 in the revolving conveyor 30' to be maintained essentially equally in a simple manner.

The rails 28, 28' form a deflector 44, 44' around the axes 36, 36' and thus connect the lower side belt face with the upper side belt face of the revolving conveyor 30'. In the region of the lower side belt face the printed products 12 are secured by a securement system 46 from falling down from the second rests 32. In the example shown here the securement system 46 consists of a support belt 47 led parallel to the lower side belt face of the revolving conveyor 30' with support slots 48 ranged at a distance a to the second saddles 34. In the end region of the lower side belt face in this example there is provided a leading-away device 82 with grippers 84.

In the region of the first axis 36 the first deflector 44 in the embodiment example shown here is designed such that those sides of the second saddles 34 adjacent the collection drum end 24 in a transfer region 50 of the revolving conveyor 30' are guided parallel to the saddles 20 of the first rests 18 of the collection drum 14 on concentric circular arc sections, which lie on essentially parallel planes neighboring one another and have the same radius. It is also conceivable for the circular arc sections to lie on planes aligned inclined to one another, this particularly being the case if the second rests 32 with their longitudinal extension are aligned at an angle deviating by 90°0 transversely to the conveying direction F. The circular arc sections may also be slightly displaced to one another instead of being concentric or may also have different radii. With all these variants it is just a question that a transfer of the printed products from the collection drum 14 to the revolving conveyor 30' e.g. using conveyor elements of the collection drum,is able to be carried out without any problem. Instead of providing the second d deflector 44' with a second axis 36' arranged parallel to the first axis 36 at the same height, as shown in FIG. 1, the second axis 36' of the diverter 44' may also be displaced in height or e.g. with an S-shaped rail guide between the diverter 44, 44', may be arranged laterally displaced to the first axis 36. The rail radius of the second deflector 44' may deviate from the first deflector 44 and may be larger as well as smaller. These possibilities of designing the revolving conveyor 30' open up a great potential in space use possibilities.

Figure 7:
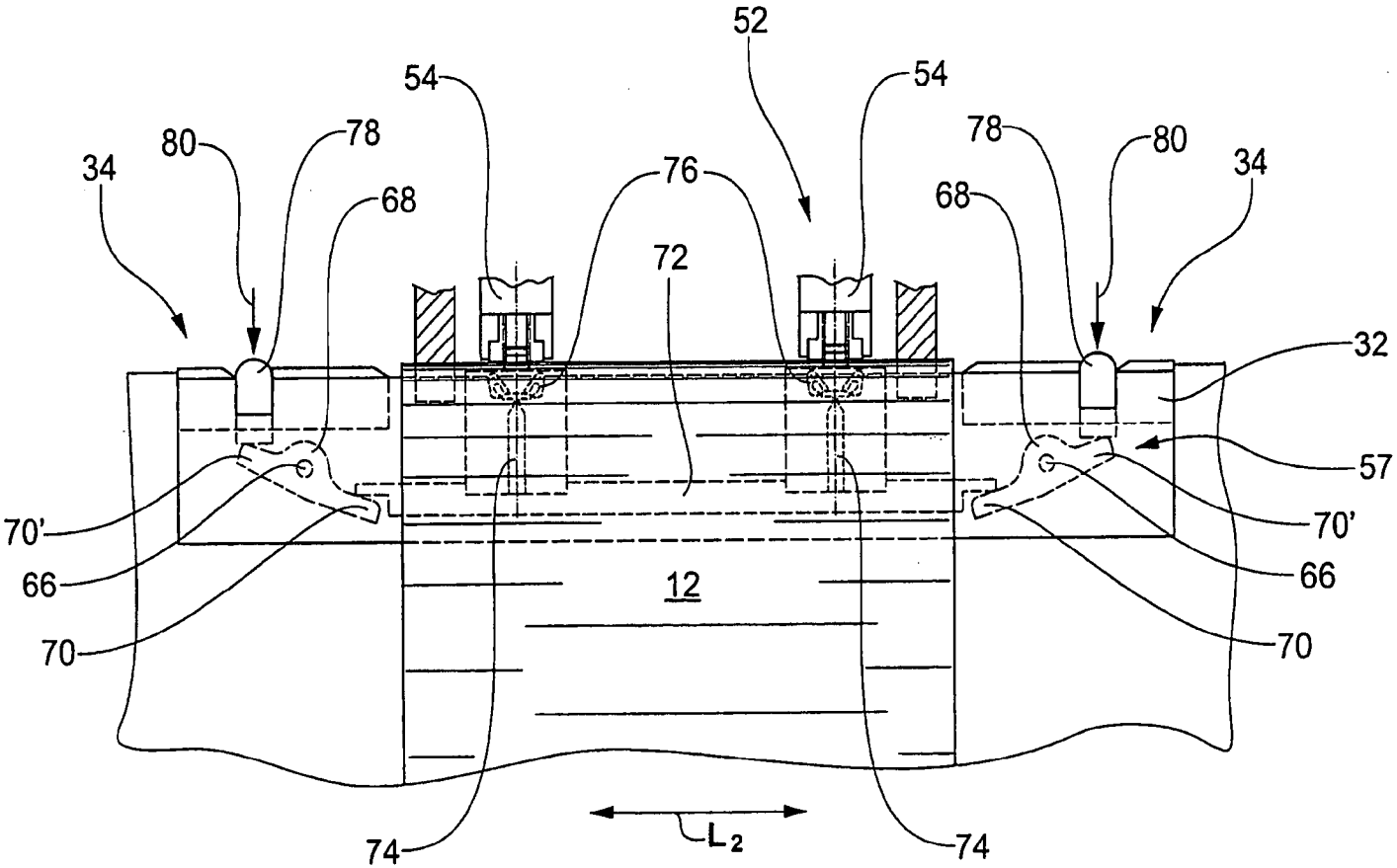
FIG. 7 which schematically illustrates an embodiment form of a rest with an integrated bending.
Figure 8:
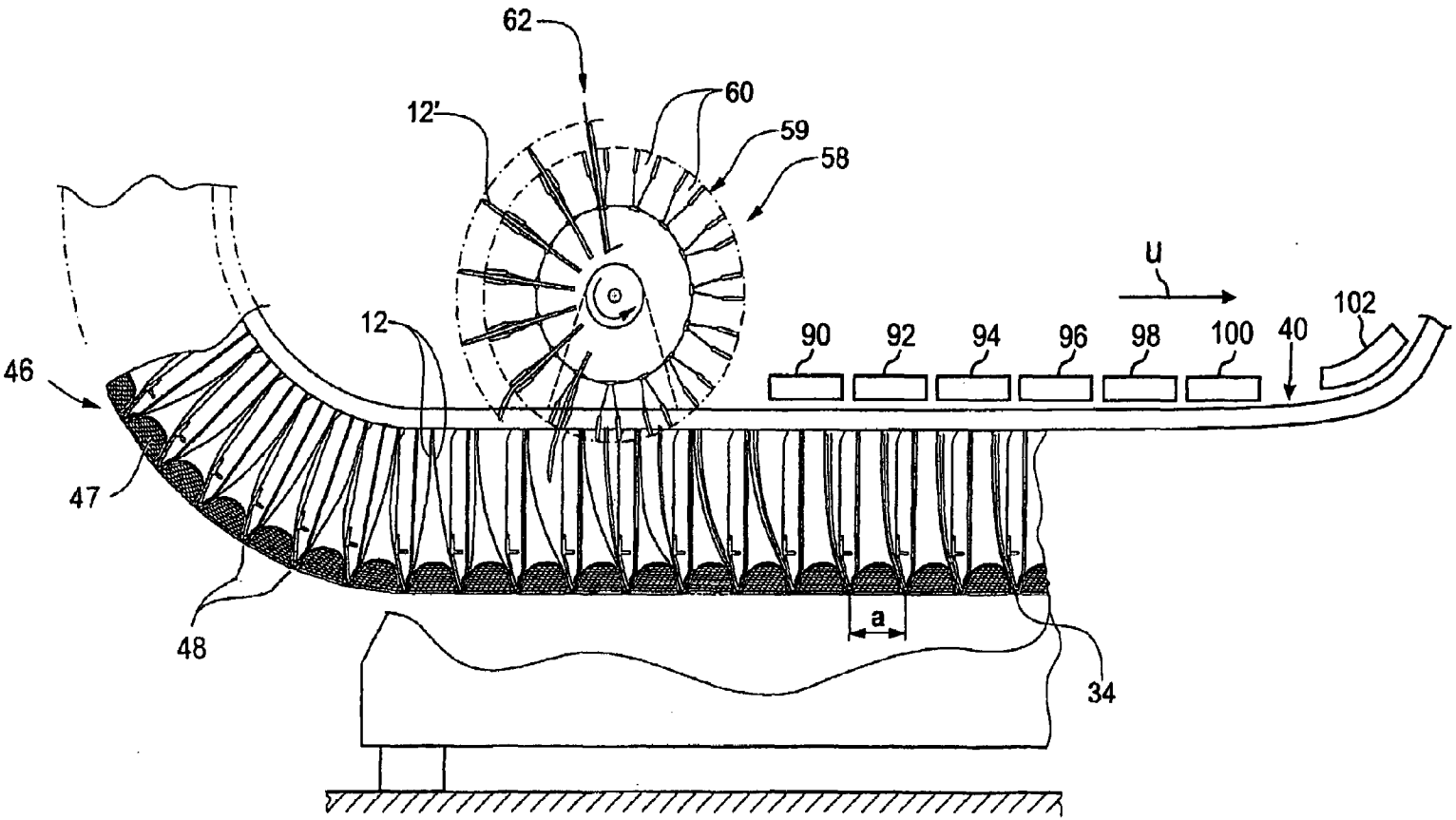
FIG. 8 schematically illustrates an embodiment form of the device with a plurality of sequentially arranged work stations.

In the example shown in FIG. 1 in the region of the upper side belt face there is arranged a stapling apparatus 52 with stapling heads 54, as are described e.g. in EP-A1-0546326, EP-B1-0399317 or EP-B1-0606555. The stapling apparatus 52 is displaceably mounted parallel to rails 56 guided parallel to the upper side belt face of the revolving conveyor 30', so that it may be placed at any point of the upper side but face. The stapling heads 54 of the stapling apparatus 52 are arranged to one another such that on operation they have the same distance a to one another as the saddles 34 of the second rests 32. The second rests 32 in the example shown here comprise integrated bending means 57, as are shown in FIG. 7 or are for example known from EP-B-0399317. It is also conceivable for the stapling apparatus 50 to comprise a bending means which for example is fastened on a carrier arm pivotably arranged on the stapling apparatus 50 whose position of pivoting may be controlled. The pivot positions are controlled such that the bending means in each case laterally below the saddle 34 which is just introduced to the printed products 12 to be stapled and for stapling cooperates with the stapling heads 54 of the stapling apparatus 52. On account of the bending means available in the whole revolving conveyor 30', the constant distance a of the saddles 34 to one another and the good support of the second rests in or on the rails 28, 28' which introduce the occurring forces into the frame 26, the stapling apparatus 52 may be applied in the example here in the region of the complete upper side belt face of the revolving conveyor 30' without any problem and without the need for retrofitting.

Figure 3:
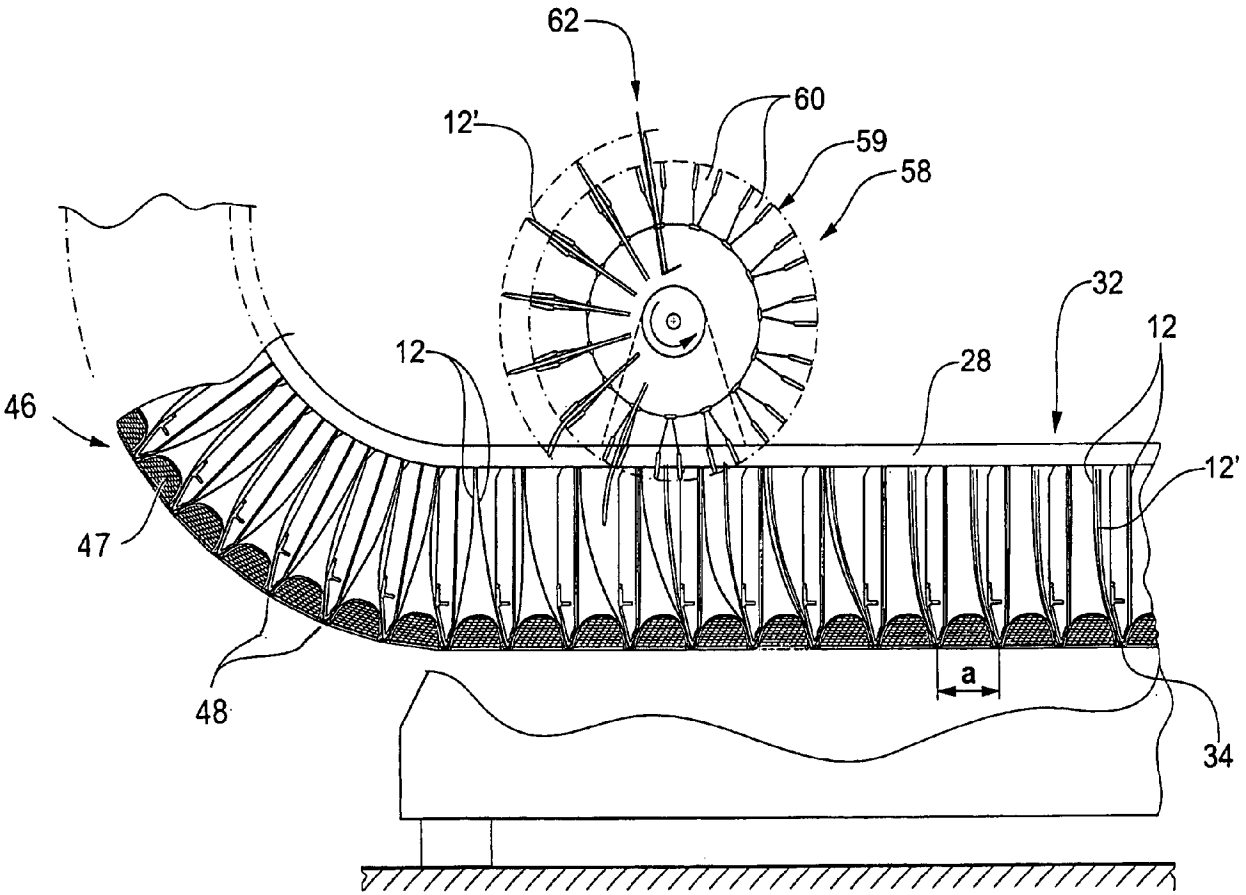
FIG. 3 which schematically illustrates a section of the device according to the invention shown in FIG. 1 with an allocated inserting station.

The frame-supported rail design of the revolving conveyor 30' permits a large accessibility radially on the inside as well as radially on the outside and from the side, so that it is possible to provide further working stations along the revolving path 31 without any problem. In FIG. 3, as one example of such a working station there is shown an inserting station 58 arranged radially on the inside. The inserting station 58 is designed as an introduction drum 59 with grip compartments 60, and laterally in the region 62 of the introduction drum 59 is fed with the printed products 12' to be inserted. The grip compartments 60 are closed in a controlled manner by sliding blocks and transport the printed products 12' up to into the lower region of the introduction drum 59, where they open likewise controlled by sliding blocks and let the printed products 12' to be inserted fall into the collected printed products. Advantageously the inserting station 58 is arranged in the region of the revolving conveyor 30' in which the saddles 34 of the second rests 32 are aligned essentially vertically downwards or downwards inclined at up to 35° to the vertical. Instead of an inserting station 58 or additionally to this one may provide further working stations such as e.g. an adhesing station for adhesing cards or sample packages or likewise. Also radially on the outside along the revolving conveyor 30' one may arrange such adhesing stations, feeders for laying on further printed products, a further stapling station in the farm of a stapling apparatus or combinations of these working stations. The number, type and sequence of working stations may be combined with one another in a useful manner along the revolving conveyor 30'.

Figure 4:
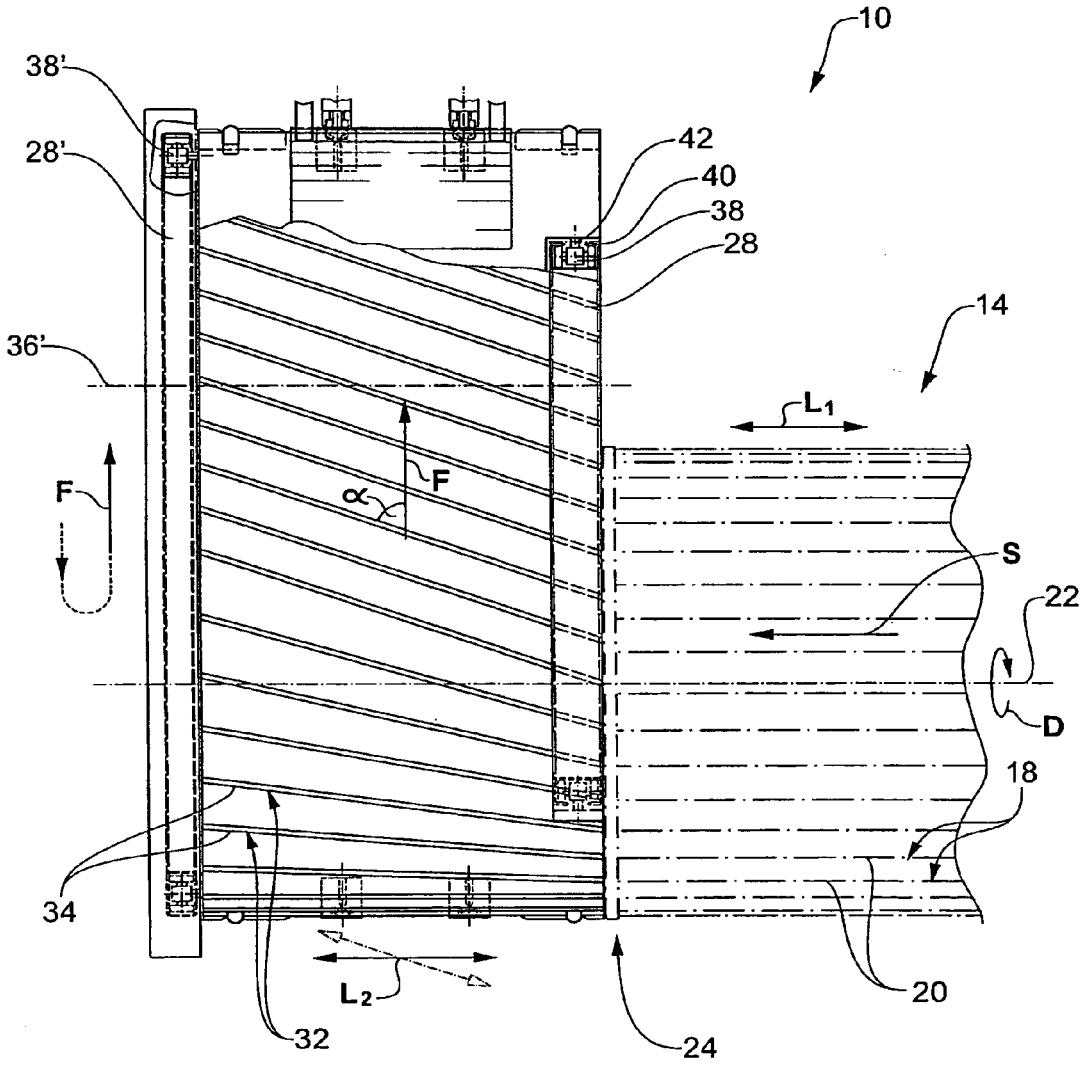
FIG. 4 which schematically illustrates in an analogous representation to the representation in FIG. 2, a second embodiment form of the device according to the invention with a conveyor in which second rests are arranged in a conveyor path of the conveyor at an angle deviating 90° from the conveying direction.

In FIG. 4 there is represented a second embodiment form of the device according to the invention in a representation analogous to the representation in FIG. 2. The device in principle is constructed equally as in the device described in FIGS. 1 and 2. The axial direction S and the conveying direction are again at right angles to one another. However the difference is the alignment of the longitudinal extension L2 of the second rests in the conveyor path 31. In contrast to the example shown in the FIGS. 1 and 2 here the second rests 32 enclose an angle $\alpha$ of about 70° with the conveyor direction F.

Figure 5:
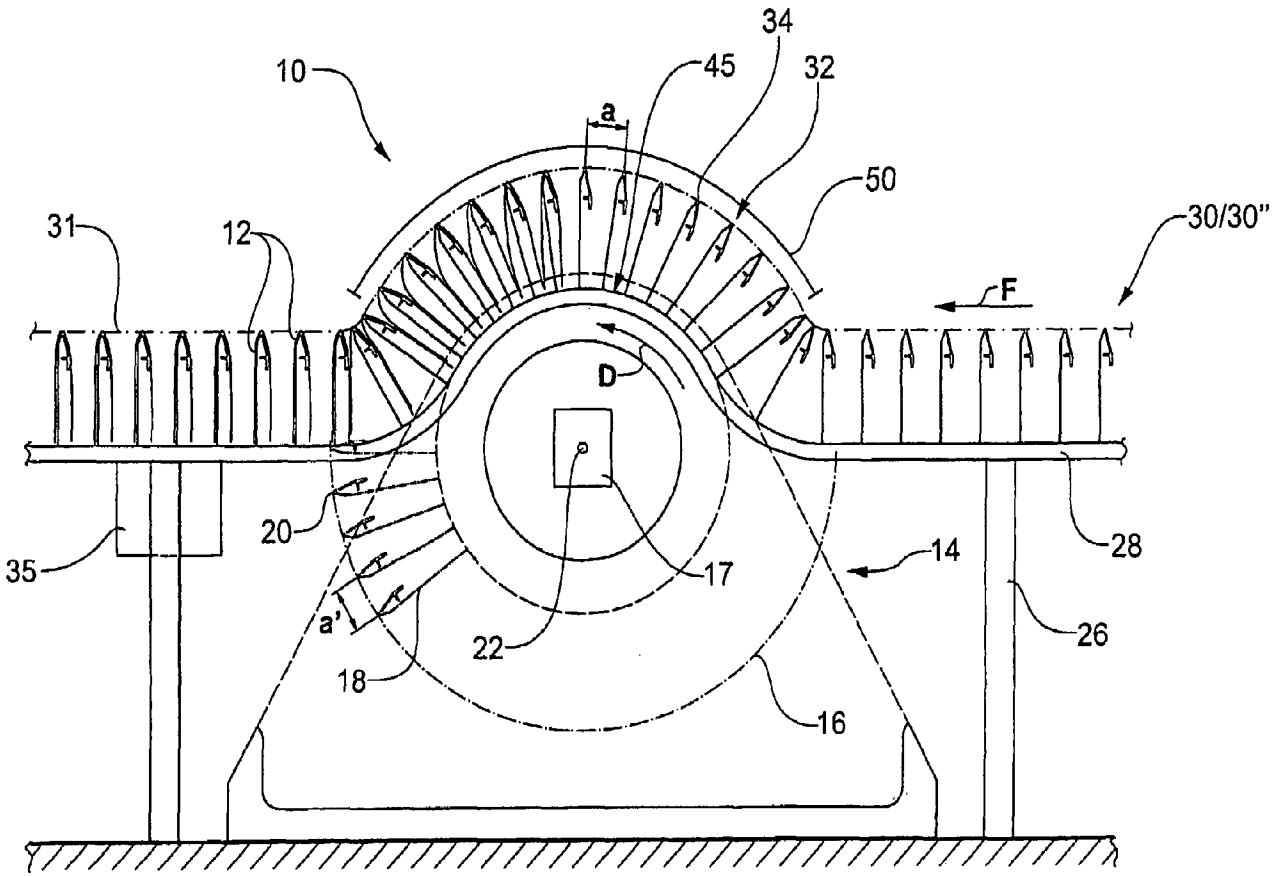
FIG. 5 which schematically illustrates a section of a further embodiment form of the device according to the invention.

In FIG. 5 there is shown a further embodiment form of the device 10 according to the invention, with which the conveyor 30 is designed as a conveyor device 30" with an essentially horizontal conveyor path 31. Thus no upper and lower side belt face is present. The conveyor path 31 is however designed such that the rests 32 moved in it may overcome level differences without any problem. In the shown example the second rests 32 of the conveyor 30 on their side distant to the second saddles 34 are movable in the conveying direction F supported in rails 28. In a transfer region 50 there is arranged a deflector 45 in the conveying direction on which the rests are guided in a manner such that least sides of the first saddles 20 and of the second saddles 34 which face one another run through concentric sections of a circular arc on planes adjacent to one another. In the example shown here the circular arc sections have an equal radius. The second saddles 34 on running through the transfer region 50 have a predefined equal distance a which is equal to the distance a' of the rests in the circumferential direction of the collection drum. The second rests 32 of the conveyor 30 in each case arrive simultaneously with the first rests 18 of the collection drum in the transfer region 50 and run through this at the same speed as these. This is possible by way of a matching of the conveyor speed introduced into the conveyor 30 via the conveyor device 30', with the rotational speed of the collection drum 14. A transfer region 50 without deflector 45 in the conveyor path 31 is also conceivable, wherein this would entail a slower transfer of the printed products 12.

It may be easily recognized that also in a revolving conveyor 30' as is shown in the FIGS. 1 and 2 one may effect a transfer instead of in the region of a diverter 44, 44' also analogously to the example shown in FIG. 5 with or without deflector 45 in the region of a side belt face.

Figure 6:
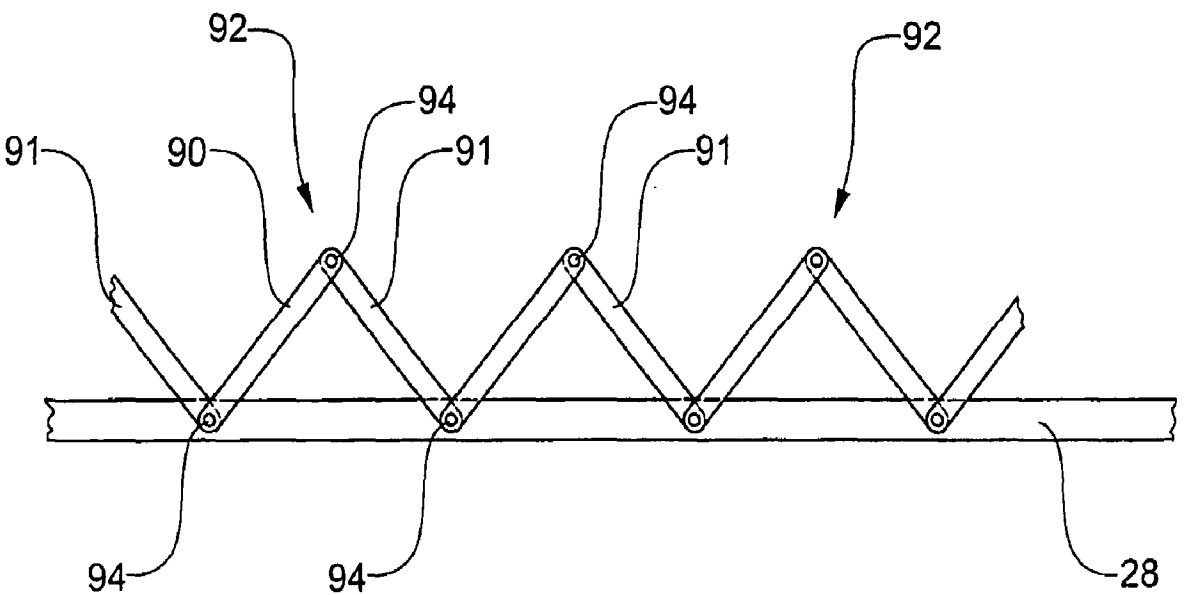
FIG. 6 which schematically illustrates an embodiment form of second rests whose limbs are connected to one another in an articulated manner.

FIG. 6 schematically shows a special embodiment form of second rests 32 which are movably guided in rails 28. The second rests 32 in each case have a first limb 90 and a second limb 91 which are connected to one another in an articulated manner in the saddle region 92 by way of a joint 94. The respective first limb 90 is furthermore connected to the respective second limb 91 of the adjacent second rest 32 via a joint 94 so that the rests form a chain similar to an accordion.

In FIG. 7 there is shown a further embodiment form of a second rest 32. In the example shown here a bending means 57 is integrated into the second rest 32. The bending means 57 is arranged on that side of the second rests 32 lying opposite to the printed products. It uses two levers 68 pivotable into the lateral end regions 64 of the rests 32 about the rotation axes 66, with in each case two lever arms 70, 70' lying opposite one another. On the lever arms lying opposite one another there is mounted a carrier element 72 which extends parallel to the longitudinal extension L2 of the second rests 32 and on which there are supported two punches 74 with associated benders 76, said punches being distanced to one another. The punches 74 with the benders 76 are arranged on the carrier element 72 such that they may cooperate with the stapling heads 54 of the stapling apparatus 52 arranged on the revolving conveyor 30'. Pressure elements 78 which may be activated controlled by sliding blocks (arrow 80) are actively connected to the respective second lever arms 70' of 68. The stapling heads 54 pierce U-shaped wire sections through the collected printed products 12 and the wire ends of these protrude. lithe pressure elements 78 press the second lever arm 70' away from the saddle 34 of the rest 32, then the carrier element 72 is pressed by the second lever arm 70' in the direction of the saddle 34 and the punches 74 actuate the benders 76 which bend the projecting wire ends.

As these examples have shown, by way of the separation of the drive of the collecting drum and conveyor one may achieve a great selection freedom for the design of the device and thus also an increased space efficiency.

What I claims is:

1. A device for collecting and processing folded printed products comprising:

a collection drum rotatingly drivable about a drum axis, the collection drum including a hub and a plurality of first rests with first saddles, the first rests being uniformly distributed over an outer circumference of the collection drum and longitudinally extending parallel to the drum axis, the collection drum having a collection drum end, the collection drum end comprising an end of each of the first rests and the hub;

a conveyor device comprising a revolving conveyor including a plurality of second rests with second saddles arranged transversely to a conveying direction, wherein the conveyor device extends axially past the collection drum and the collection drum end of the collection drum; and the conveyor device in a transfer region arranged adjacent to the collection drum end, wherein in the transfer region one of the first rests and first saddles aligns with one of the second rests and second saddles, wherein the printed products on the first rests of the collection drum are transportable in an axial direction of the collection drum to the collection drum end of the collection drum and axially past the collection drum end so as to be transferred to the second rests of the revolving conveyor.

2. The device according to claim 1, wherein the conveyor device comprises a frame supporting the revolving conveyor, the frame is disposed adjacent the collection drum end, and a portion of the frame is disposed adjacent to the end of the hub.

3. The device according to claim 1, wherein the hub is not a component of the conveyor device, and no part of the collection drum is an integral component of the conveyor device.

4. The device according to claim 1, wherein the conveyor device in the transfer region is arranged adjacent to the collection drum end of the collection drum in a manner such that the printed products maybe transferred from the collection drum end to the conveyor means or vice versa.

5. The device according to claim 1, wherein the conveyor device is detached from the collection drum.

6. The device according to claim 1, wherein the second saddles at least in the transfer region are movable parallel to one another at a predefined, equal distance in a conveyor path, wherein the equal distance of the saddles corresponds to a distance between the first saddles in a circumferential direction of the collection drum.

7. The device according to claim 6, wherein a rotational speed of the collection drum and a conveyor speed are matched in a manner such that one of the first saddles remains aligned with one of the second saddles while moving through the transfer region.

8. The device according to claim 1, wherein the conveyor device comprises a deflection member on which the second rests are disposed, the deflection member forming a circular conveyor arc matching a circular collection drum arc in the transfer region.

9. The device according to claim 1, wherein the second rests are movably supported on rails.

10. The device according to claim 9, wherein each of the second rests, on a side lying opposite one of the second saddles, are supported on at least one rail.

11. The device according to claim 1, wherein at least one working station, selected from inserting stations, binding stations, adhering stations, or further collection stations, is disposed in combination with the conveyor device.

12. The device according to claim 1, further comprising a stapling apparatus disposed in combination with the conveyor device.

13. A device for collecting and processing folded printed products comprising:

a collection drum rotatingly drivable about a drum axis, the collection drum including a hub and a plurality of first rests with first saddles, the first rests being uniformly distributed over an outer circumference of the collection drum and longitudinally extending parallel to the drum axis, the collection drum having a collection drum end, the collection drum end comprising an end of each of the first rests and the hub; and a conveyor device detached from the collection drum, extending axially past the collection drum and the collection drum end of the collection drum, and arranged adjacent to the collection drum end in a transfer region, the conveyor device comprising a revolving conveyor including a plurality of second rests with second saddles arranged transversely to a conveying direction, wherein the conveyor device in the transfer region is arranged adjacent to the collection drum end of the collection drum in a manner such that the printed products may be transferred from the collection drum end to the conveyor device or vice versa, wherein the printed products on the first rests of the collection drum are transportable in an axial direction of the collection drum to the collection drum end of the collection drum and axially past the collection drum end so as to be transferred to the second rests of the revolving conveyor.

14. The device according to claim 13, wherein in the transfer region each of more than one of the first rests and first saddles aligns with a corresponding one of the second rests and second saddles.

15. The device according to claim 13, wherein the conveyor device comprises a frame supporting the revolving conveyor, the frame is disposed adjacent the collection drum end, and a portion of the frame is disposed adjacent to the end of the hub.

16. The device according to claim 13, wherein the second saddles at least in the transfer region are movable parallel to one another at a predefined, equal distance in the conveyor path, the equal distance of the saddles corresponds to a distance between the first saddles in the circumferential direction of the collection drum, and a rotational speed of the collection drum and a conveyor speed are matched in a manner such that one of the first saddles remains aligned with one of the second saddles while moving through the transfer region.

17. The device according to claim 13, wherein the conveyor device comprises a deflection member on which the second rests are disposed, the defection member forming a circular conveyor arc matching a circular collection drum arc in the transfer region.

18. The device according to claim 13, wherein at least one working station, selected from stapling stations, inserting stations, binding stations, adhering stations, or further collection stations, is disposed in combination with the conveyor device.

19. A device for collecting and processing folded printed products comprising:

a collection drum which is rotatingly drivable about a drum axis and comprises first rests with first saddles, the first rests being uniformly distributed over the circumference of the drum having a hub and extending in a longitudinal extension parallel to the drum axis, the collection drum having a collection drum end, the collection drum end comprising an end of each of the first rests and the hub;

conveyor elements in combination with the collection drum for conveying the printed products on the first saddles in an axial direction along the firsts rests; and a conveyor device that extends axially past the collection drum and the collection drum end of the collection drum, the conveyor device comprising a conveyor path with a conveyor direction which at least in a transfer region deviates from the axial direction, the conveyor device including second rests movable in the conveyor path, the second rests having second saddles arranged distanced to one another and arranged transversely to the conveying direction;

wherein the conveyor device in the transfer region is arranged adjacent to the collection drum end of the collection drum in a manner such that the printed products may be transferred from the collection drum end to the conveyor device or vice versa, and for the second rests movable in the conveyor path there is provided a conveyor unit that is detached from the collection drum, wherein the printed products on the first rests of the collection drum are transportable in the axial direction of the collection drum to the collection drum end of the collection drum and axially past the collection drum end so as to be transferred to the second rests of the revolving conveyor.

20. The device according to claim 19, wherein the conveyor device comprises a frame supporting a revolving conveyor, the frame is disposed adjacent the collection drum end, and a portion of the frame is disposed adjacent to the end of the hub.

21. The device according to claim 19, wherein the second saddles at least in the transfer region are movable parallel to one another at a predefined, equal distance in the conveyor path, the equal distance of the saddles corresponds to a distance between the first saddles in the circumferential direction of the collection drum, and a rotational speed of the collection drum and a conveyor speed are matched in a manner such that one of the first saddles remains aligned with one of the second saddles while moving through the transfer region.

22. The device according to claim 19, wherein the axial direction and the conveyor direction are essentially perpendicular to one another at least in the transfer region.

23. The device according to claim 19, wherein at least one working station, selected from stapling stations, inserting stations, binding stations, adhering stations, or further collection stations, is disposed in combination with the conveyor device.

* * * * *